United States Patent [19]

Nill

[11] 4,449,951

[45] May 22, 1984

[54] METHOD OF ADJUSTING THE ELECTRODE SPACINGS IN SYSTEMS OF ELECTRON-BEAM TUBES

[75] Inventor: Eberhard Nill, Esslingen, Fed. Rep. of Germany

[73] Assignee: International Standard Electric Corporation, New York, N.Y.

[21] Appl. No.: 298,848

[22] Filed: Sep. 3, 1981

[30] Foreign Application Priority Data

Sep. 24, 1980 [DE] Fed. Rep. of Germany ..... 3035970

[51] Int. Cl.[3] ..... H01J 9/18

[52] U.S. Cl. ..... 445/34; 445/67; 445/36

[58] Field of Search ..... 445/3, 4, 34, 36, 67; 313/414

[56] References Cited

U.S. PATENT DOCUMENTS

| | | | |
|---|---|---|---|
| 2,611,676 | 9/1952 | Pohle | 445/4 |
| 2,864,935 | 12/1958 | Johnson | 445/4 |
| 3,643,299 | 2/1972 | Brown | 445/3 |
| 4,176,432 | 12/1979 | McCandless | 445/34 |
| 4,259,610 | 3/1981 | Takanashi | 445/34 |

*Primary Examiner*—Nicholas P. Godici
*Assistant Examiner*—Kurt Rowan
*Attorney, Agent, or Firm*—James B. Raden; William J. Michals

[57] ABSTRACT

For the purpose of the exact position adjustment and mounting of the cathodes (3) in their supporting plates (4) outside the system of a TV-Picture tube electron gun, the fitting position of the supporting plate and the fitting positions of the cathodes in this supporting plate are transferred to the outside of the system with the aid of a measuring head comprising independently guided spacing jigs (8, 10) for transferring the fitting position instead of having to use a limit stop lying outside the system.

3 Claims, 2 Drawing Figures

METHOD OF ADJUSTING THE ELECTRODE SPACINGS IN SYSTEMS OF ELECTRON-BEAM TUBES

Figure 1:
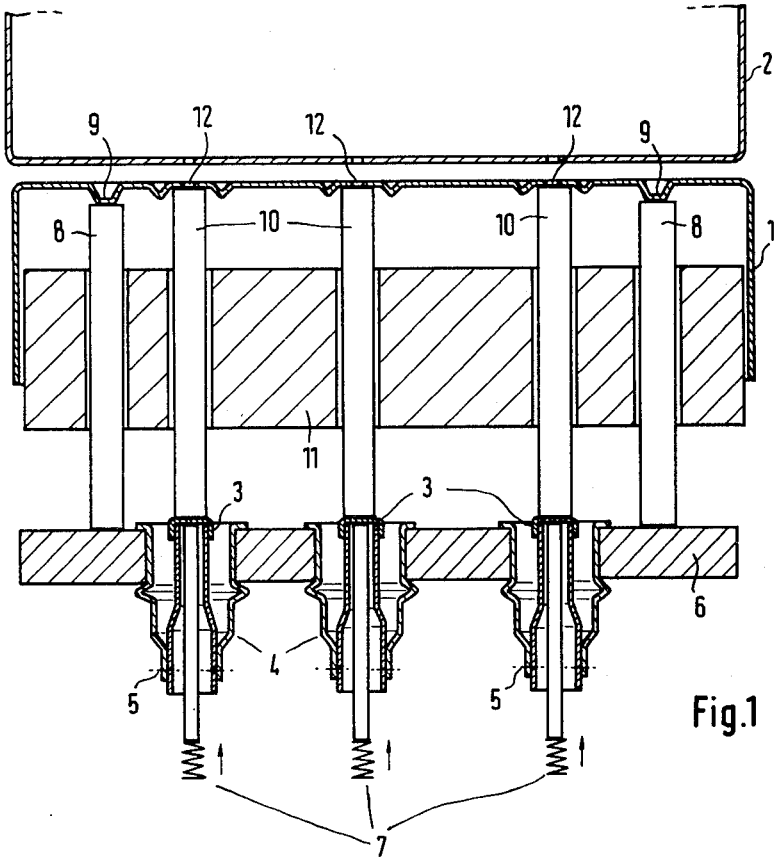

The present invention relates to a method of adjusting the electrode spacings in systems of electron-beam tubes which are used as multigun cathode-ray tubes, e.g. in colour television picture tubes.

Generating, forming and controlling the electron beam which, for producing the image, is still subjected to magnetic deflection, is carried out within the so-called system consisting chiefly of three sequences of cathodes, control grids and beam-forming electrodes arranged next to each other.

In one particular type of embodiment three individual cathodes for generating the red, blue and green components of the image, are arranged opposite a first electrode G1 which is common to all, and which has three apertures permitting the passage of the three electron beams. This is followed, at a correspondingly larger spacing, by the second electrode G2. The very small spacing K-G1 between the cathode K and the first electrode G1 is a critical one. With e.g. approximately 100 μm it affects the ratings of the tube about 3 to 4 times as much as the spacing G1-G2 between the electrode G1 and the next electrode G2 which is several times greater. Accordingly, it is important for the spacing K-G1 to be adjusted exactly when assembling the system.

From DE-OS No. 23 55 240 it is known to adjust the spacing from the electrode G2 to the cathode surface through G1 with the aid of a spacing jig. This, however, requires an exact spacing G2-G1, exact electrode thicknesses as well as the beam apertures to have no burrs.

With a view to this difficulty, adjusting means have been used according to the prior art invention, which are inserted into the critical distance K−G1=D itself, adjusting this distance first of all to a much too great a value. Upon removal of these adjusting means this excessive distance is reduced to the nominal distance D in that the supports of K and G1 are approached by an amount likewise defined by jigs. In so doing, the cathodes are slipped into sleeve-shaped parts of the system and secured therein. This, however, has the great disadvantage that during the mounting of the cathodes inside the sleeves and thereafter, the critical spacing can no longer be observed and corrected. Once the exactly adjusted spacing of the cathodes inside the sleeves is lost during the mounting it might happen, under certain circumstances, that a larger number of systems with inaccurate spacings is manufactured, because the tube characteristics can only be checked again on the vacuum-tightly enclosed system. A further disadvantage resides in that two spacings have to be adjusted, i.e. when the cathode is first of all arranged at the reference spacing from its future neighbouring electrode G1, and when thereupon the cathode is moved by the amount "reference spacing minus the desired distance D" in direction towards G1. In the course of this, compared with the direct positioning with the aid of jigs and without this intermediate step, additional adjusting tolerances occur. It is the object of the invention to eliminate these disadvantages.

A direct positioning with the aid of jigs without an intermediate adjusting step as proposed by the invention, provides the possibility of effecting the mounting of the cathode inside its mounting sleeve in an exact position. During the mounting it is possible to check and, if necessary, to correct by way of readjustment. According to the invention, this is accomplished in that the grid cathode spacings are adjusted directly via jigs, with the fitting position of one or more cathodes in the holders of a common mounting plate, by way of a simultaneous individual adjustment, being determined still outside the entire system hence, in terms of time, prior to the insertion of the mounting plate, with the cathode, after having been adjusted, also being firmly connected to the holders of its common mounting plate already outside the entire system. To make it possible for this to be carried out outside the system, there is used a reference body which, for the sake of enabling a better understanding, is shown and referred to as a mounting plate into which the mounting sleeves of the cathodes are already firmly inserted, and on which the later fitting position which, in the assembled system is determined by the application to the limit stops of the electrode G1, is transferred during the adjustment and the mounting of the cathodes in their holders, with the aid of spacing jigs.

Upon removal of these spacing jigs after the cathodes have been inserted, the mounting plate can be inserted into the exact final position within the entire system, by meeting against limit stops. Accordingly, it only still remains necessary to safeguard that, in the mounting plate, the cathodes are secured in the proper position, i.e. by taking into consideration the actual position of the areas neighbouring it on the electrode G1. According to the invention, this is accomplished in that the position of those electrode areas which contain the aperture and which, in the assembled state of the system, are supposed to be arranged exactly opposite the neighbouring cathodes with a distance D between them, in relation to the cathodes is likewise transferred with the aid of spacing jigs which are longer by the amount D.

With a view to the asymmetries existing within the entire system it may be desirable for the spacings between the cathode K and the electrode G1 to be adjusted somewhat differently. This is easy to accomplish in cases where only the amount of the distance D is different with respect to the individual cathodes, and where all spacing jigs are capable of being shifted independently of one another in a guide plate common to all which may consist of several parts firmly connected to one another. In reality, the adjusting means referred to as spacing jigs, are not necessarily spacing bodies, such as precision gauges or end blocks. It is of advantage for the spacing jigs to be provided with mechanical, inductive, capacitive or pneumatic detecting elements.

The invention will now be explained in greater detail with reference to FIGS. 1 and 2 of the accompanying drawings, in which:

FIG. 1 is a schematical representation of the adjusting method, with the references indicating the following:

1 indicates the electrode G1 (control grid, Wehnelt cylinder)
2 indicates the electrode G2 (screen grid)
3 indicates the electrode K (cathode)
4 indicates the sleeve inside which the cathode is secured at the points 5
5 indicates the point at which the cathode is secured to the sleeve
6 indicates the cathode supporting plate (reference body) herein referred to as the mounting plate 7 indicates symbols relating to the cathode adjustment. These symbols refer to e.g. a mechanical, magnetic or pneumatic force which, in the axial direction, adjusts the cathodes to the spacings as determined by the jigs 10, in direction towards these jigs.

8 indicate jigs which serve to determine the spacing between the mounting plate 6 and the limit stops 9 on the electrode G1 during the cathode adjustment. During the assembly, the mounting plate 6 is applied to the limit stops 9.

9 indicate the limit stops against which the plate 6 is applied when meeting against G1 in the readily assembled state.

10 indicate the jigs for adjusting the cathode spacing prior to the mounting of the cathodes inside the mounting sleeves, for observing this spacing during the mounting and thereafter. These jigs are by the respective distance cathode-electrode G1 longer than the jigs 8.

11 indicates the guide plate in which the spacing jigs 8 and 10 are capable of being shifted or displaced in relation to one another.

12 indicate the apertures permitting the passage of the electron beams.

Figure 2:
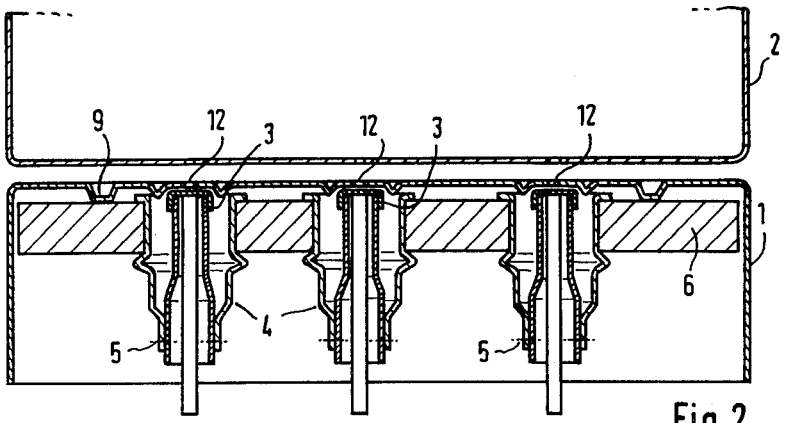

FIG. 2 shows the state after the measuring head has been removed.

With modern types of colour TV picture tubes the permissible variation of the cathode current operating point has been increasingly restricted in order to reduce the circuit investment for the receivers, and in order to safeguard a uniform quality of sharpness of the image.

Apart from the thicknesses of the material and the aperture diameters of the electrodes G1 (1) and G2 (2) the spacings G1-K (3) and G1-G2 are main factors influencing the magnitude of the operating voltage. Relative thereto, the spacing G1-K enters into the result about 3 to 4 times as strongly as the spacing G1-G2. As a consequence of this, and for achieving a narrow spread of the operating voltage values, the spacing G1-K must be dimensioned very exactly. Therefore, according to the invention, adjustment and assembly are carried out as follows:

1. Into the readily glass-connected system there is introduced from below, i.e. into G1, a detecting element consisting of the guide plate 11 and the jigs 8 and 10, with this element, via these jigs, imaging the internal limit stops for the mounting plate (jigs 8) as well as the interior wall of G1 within the surroundings of the three apertures (jigs 10) towards the outside.

2. The mounting plate 6 with the preassembled, e.g. riveted cathode holding sleeves 4, is moved towards the jigs 8, i.e. is brought into a defined spacing in relation to G1.

3. The three cathodes 3 are moved inside the sleeves 4 against the jigs 10 and are welded in this position to the sleeves, preferably by way of laser welding. In the course of this, the jigs 10, as end blocks, may serve as mechanical limit stops, or else may be provided with (either inductive, capacitive or pneumatic) detecting elements for effecting the contactless positioning.

4. During the welding, it is possible with the aid of the detecting elements, to watch for any variations of the adjusted spacing throughout the entire mounting process.

5. The whole measuring group is removed from the Wehnelt cylinder after it has proved that the spacings have remained unchanged or only vary within permissible limits.

6. The mounting plate with the cathodes now welded in position, is inserted into the electrode G1 by meeting against the limit stops 9, and is fixed therein e.g., by means of crimp points.

In the course of this procedure it is of advantage to fix the cathodes in position as long as the spacing jigs 8 and 10 are still in action, and as long as the mounting plate has not yet been inserted into the entire system. If, in the course of the mounting, the adjusted K-G1 spacing is changed, this is immediately recognizable, and the final assembly is not carried out, so that the entire system is prevented from becoming unusable. After this it is also possible to perform a new adaptation for a readjustment of the cathodes. For this purpose, the sleeves 4 are designed in a suitable way to be deformable.

Another great advantage of the invention resides in that for removing the measuring head (8, 10 and 11) the spacing of the mounting plate from the system can be temporarily enlarged without it being necessary to maintain the adjusting accurracy, because the approach for the purpose of the final assembly is carried out in any way by approaching the mounting plate to the limit stops 9. In this way it is possible to design the G1-electrode to have a pot shape which is necessary for stabilizing the structure. This could not be achieved if, as is the case with conventional types of arrangements, the measuring head has to be removed after the adjustment, in the sideway direction, hence transversely in relation to the axial direction of the system. During the assembly, in the vertical drawing plane, an extensive compensation of the remaining tolerances will result when the three limit stops 9 are arranged as far as possible towards the outside.

I claim:

1. A method of adjusting the electrode spacings in an electron-beam tube of the type wherein a cathode electrode mounting plate is provided with at least one cathode electrode mounted in a holding sleeve and wherein said mounting plate is mounted within a second electrode having electron apertures therein which are respectively axially aligned with each of the cathode electrodes and separated therefrom by a predetermined electrode spacing, said method comprising the steps of:

(a) inserting a guide plate into said second electrode, said guide plate having at least one guide hole therein respectively axially aligned with said apertures and having at least one spacing hole therein which is spaced apart from said guide holes;

(b) inserting an axially extending cathode jig member into each of said guide holes until one end portion thereof engages said second electrode, and each cathode jig member having a predetermined axial length;

(c) inserting an axially extending spacing jig member into each of said spacing holes until one end portion thereof engages said second electrode, and each spacing jig having a predetermined axial length which is less than the axial length of said cathode jig member by an amount equal to said predetermined electrode spacing;

(d) moving said mounting plate into engagement with the other end of said spacing jig member;

(e) moving said cathode electrodes in said sleeve until the ends of said cathode electrodes engage the other ends of said cathode jig members;

(f) fastening said cathode electrodes to said sleeves;

(g) removing said guide plate from said second electrode;

(h) inserting said mounting plate with its fastened cathode electrodes into said second electrode; and, (i) fastening said mounting plate to said second electrode.

2. The method according to claim 1, wherein said second electrode includes at least one internal raised limit stop which engages said mounting plate to space said mounting plate away from said apertures and wherein step (c) includes the step of engaging said one end portion of said spacing jig member against said internal limit stop.

3. The method according to claim 2, wherein the shape of said second electrode is cylindrical having a substantially closed bottom at its axially inner end upon which said apertures and said internal limit stop are formed.

* * * * *